US008075292B2

(12) United States Patent
Yun

(10) Patent No.: US 8,075,292 B2
(45) Date of Patent: Dec. 13, 2011

(54) ECCENTRIC ROTOR COMPRESSOR

(76) Inventor: Xiaoying Yun, Beijing (CN)

( * ) Notice: Subject to any disclaimer, the term of this patent is extended or adjusted under 35 U.S.C. 154(b) by 411 days.

(21) Appl. No.: 12/374,479

(22) PCT Filed: Jul. 25, 2007

(86) PCT No.: PCT/CN2007/002254

§ 371 (c)(1),
(2), (4) Date: Jan. 20, 2009

(87) PCT Pub. No.: WO2008/014688

PCT Pub. Date: Feb. 7, 2008

(65) Prior Publication Data

US 2009/0169407 A1 Jul. 2, 2009

(30) Foreign Application Priority Data

Jul. 26, 2006 (CN) ..... 2006 1 0103702
Jul. 26, 2006 (CN) ..... 2006 1 0103703

(51) Int. Cl.
*F03C 2/00* (2006.01)
*F03C 4/00* (2006.01)
*F04C 18/00* (2006.01)

(52) U.S. Cl. ..... 418/62; 418/66; 418/248; 418/249

(58) Field of Classification Search ..... 418/62, 418/65, 66, 248, 249
See application file for complete search history.

(56) References Cited

U.S. PATENT DOCUMENTS 1,012,237 A * 12/1911 Bond ..... 418/248
1,681,583 A * 8/1928 Guttner ..... 418/62
2,094,525 A * 9/1937 Calling ..... 418/62
2,238,395 A * 4/1941 Nittka ..... 418/248
4,423,710 A * 1/1984 Williams ..... 418/248
6,827,564 B2 * 12/2004 Becker ..... 418/62
2004/0071577 A1 4/2004 Becker
2006/0245966 A1 * 11/2006 Yun ..... 418/62

FOREIGN PATENT DOCUMENTS

CH 657665 A5 * 9/1986 ..... 418/248
CN 1707110 12/2005
CN 1707110 A 12/2005
CN 1262392 A 8/2008
FR 1341348 A * 9/1963 ..... 418/62
GB 2242708 10/1991

(Continued)

OTHER PUBLICATIONS

Yun, Xiaoying, Title: A Rotary Piston Compressor. Parent Patent Application: International Patent Application Publication WO2008014688 with Search Report (ISA=CN). Published Feb. 7, 2008.

*Primary Examiner* — Theresa Trieu
(74) *Attorney, Agent, or Firm* — Babcock IP, PLLC

(57) ABSTRACT

A rotary piston compressor comprises a cylinder block (100), an eccentric rotor group (200) being fitted in the chamber of the cylinder block, a shaft (2) and a separating means (40). The eccentric rotor group (200) comprises a cylindrical rotor (4) provided on the shaft (2) and rotatable therewith, and a collar (3) rotationally provided on the cylindrical rotor (4). The separating means (40) is used for separating the axially extended sealed chamber, which is formed between the outer peripheral surface of the eccentric rotor group (200) and the inner wall of the cylinder block (100), into an induction chamber (70) and an exhaustion chamber (71). Wherein, the separating means (40) comprises: a baffle (8) provided between the inner wall of the cylinder block (100) and the collar (3) provided on the outer periphery of the eccentric rotor (4), a contact member (7) provided between the baffle (8) and the collar (3) and contacted therewith, and a jointing element (6) connecting the contact member (7) to the baffle (8) and the collar (3) respectively.

8 Claims, 9 Drawing Sheets

FOREIGN PATENT DOCUMENTS

| | | |
|---|---|---|
| RU | 1779786 | 12/1992 |
| RU | 2103553 | 1/1998 |
| WO | 9958855 | 11/1999 |
| WO | 0173266 | 10/2001 |

* cited by examiner

ECCENTRIC ROTOR COMPRESSOR

FIELD OF THE INVENTION

The invention relates to an energy conversion device which converts mechanical energy into pressure energy, and particularly to a rotor compressor.

BACKGROUND OF THE INVENTION

Conventional rotor compressors have significant advantages compared to other types of compressors, but they have the following drawbacks: the manufacturing process is complicated, the sealing is not reliable, and the reliability of the mechanical structure and the sealing drops significantly especially when the volume increases, and as a result, it is difficult to increase flow volume. The main reason that results in the above drawbacks lies in that the movable separating block, which separates the high pressure chamber from the low pressure chamber, has a small moving range and has a poor reliability. And when increasing the flow volume, the manufacturing process is more difficult to realize.

SUMMARY OF THE INVENTION

In consideration of the above, an object of the invention is to provide a rotor compressor comprising:

a cylinder block which comprises a cylinder block body, a front end cover and a rear end cover which are attached to a front end surface and a rear end surface of the cylinder block body respectively, the cylinder block body and the front and rear end covers defining an inner chamber;

an eccentric rotor assembly fitted in the inner chamber of the cylinder block, the eccentric rotor assembly comprising a cylindrical rotor and a bush which is rotatably fitted over the cylindrical rotor, the bush contacting an inner wall of the cylinder block so as to form an axially extending sealing region;

a shaft, the cylindrical rotor being mounted on the shaft and being rotatable therewith;

separating means for separating an axially extending sealed chamber into an induction chamber and an exhaustion chamber, the axially extending sealed chamber being formed between the outer circumferential surface of the eccentric rotor assembly and the inner wall surface of the cylinder block, the induction chamber and the exhaustion chamber communicating with an inlet and an outlet respectively;

wherein the separating means comprising:

a separator plate which is provided with a pivot shaft at an end opposite to the eccentric rotor assembly, the cylinder block body being formed with an axially extending hole which opens to the inner chamber, the pivot shaft being fitted in the hole and being rotatably supported by the hole so that the separator plate can rotate in a predetermined range;

one of the separator plate and the bush being provided with a contact member, the contact member comprising an axially extending cylindrical surface, and the other one of the separator plate and the bush being formed with an axially extending circular arc slot, the cylindrical surface being positioned in the circular arc slot and making a sealing contact with the circular arc slot;

the contact member being connected with the other one of the separator plate and the bush by means of a connecting member, the connection provided by the connecting member allowing the separator plate and the bush to rotate relative to each other with a central axis of the cylindrical surface as an axis.

Preferably, the contact member is fixedly attached to the separator plate, and the axially extending circular arc slot is formed on an outer circumferential surface of the bush.

Preferably, the contact member is fixedly attached to the bush, and the axially extending circular arc slot is formed on the separator plate.

Preferably, the contact member is formed with an axial hole at an axial end thereof and a sectorial cutout with the axial hole as a center, and a center of the axial hole coincides with a center of the cylindrical surface of the contact member;

the bush is formed with an axial hole at an axial end thereof and a slot which opens to the axial hole;

the connecting member takes the shape of U, its two legs are respectively received in the axial hole of the contact member and the axial hole of the bush, and a connecting part, which connects the two legs of the connecting member, is located within the sectorial cutout of the contact member and the slot of the bush.

Preferably, the contact member is formed with an axial hole at an axial end thereof and a sectorial cutout with the axial hole as a center, and a center of the axial hole coincides with a center of the cylindrical surface of the contact member;

the separator plate is formed with an axial hole at an axial end thereof and a slot which opens to the axial hole;

the connecting member takes the shape of U, its two legs are respectively received in the axial hole of the contact member and the axial hole of the separator plate, and a connecting part, which connects the two legs of the connecting member, is located within the sectorial cutout of the contact member and the slot of the separator plate.

Preferably, the inlet and outlet are formed on the cylinder block body or the front and rear end covers.

Preferably, a receiving recess is formed in the inner wall of the cylinder block body, so that the separator plate is received in the receiving recess when pivoting to the uppermost position due to the rotation of the rotor assembly.

Preferably, the outlet is provided with a check valve which takes the form of a cylindrical valve, the cylindrical valve comprises a cylindrical closing and opening member for closing the outlet of the exhaustion chamber.

According to another aspect of the invention, the rotor compressor may include a plurality of cylinders. And in the rotor compressor with a plurality of cylinders, the rotors are so arranged as to achieve dynamic balance.

With the separating means of the invention, the volume efficiency of the rotor compressor is increased greatly, and the rotor compressor has a simple structure and an excellent manufacturability, and achieves rational conditions for mechanical movement, the noise and vibration can be further reduced.

BRIEF DESCRIPTION OF THE ACCOMPANYING DRAWINGS

The invention will be described in detail with reference to the accompanying drawings, in which FIG. 1 is a cross-sectional view of the rotor compressor in accordance with the first embodiment of the invention;

DETAILED DESCRIPTION OF THE PREFERRED EMBODIMENTS

Figure 1:
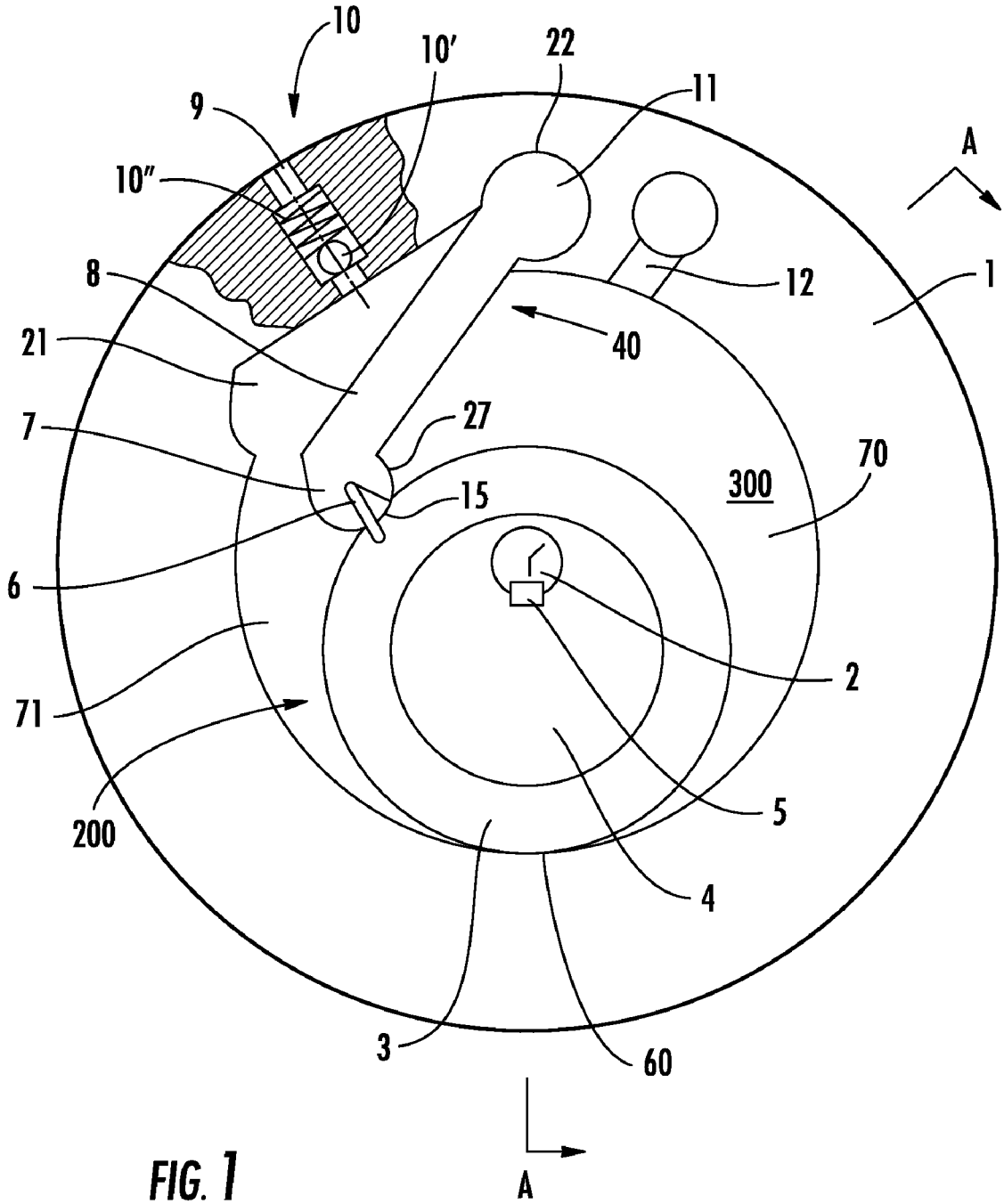
Figure 2:
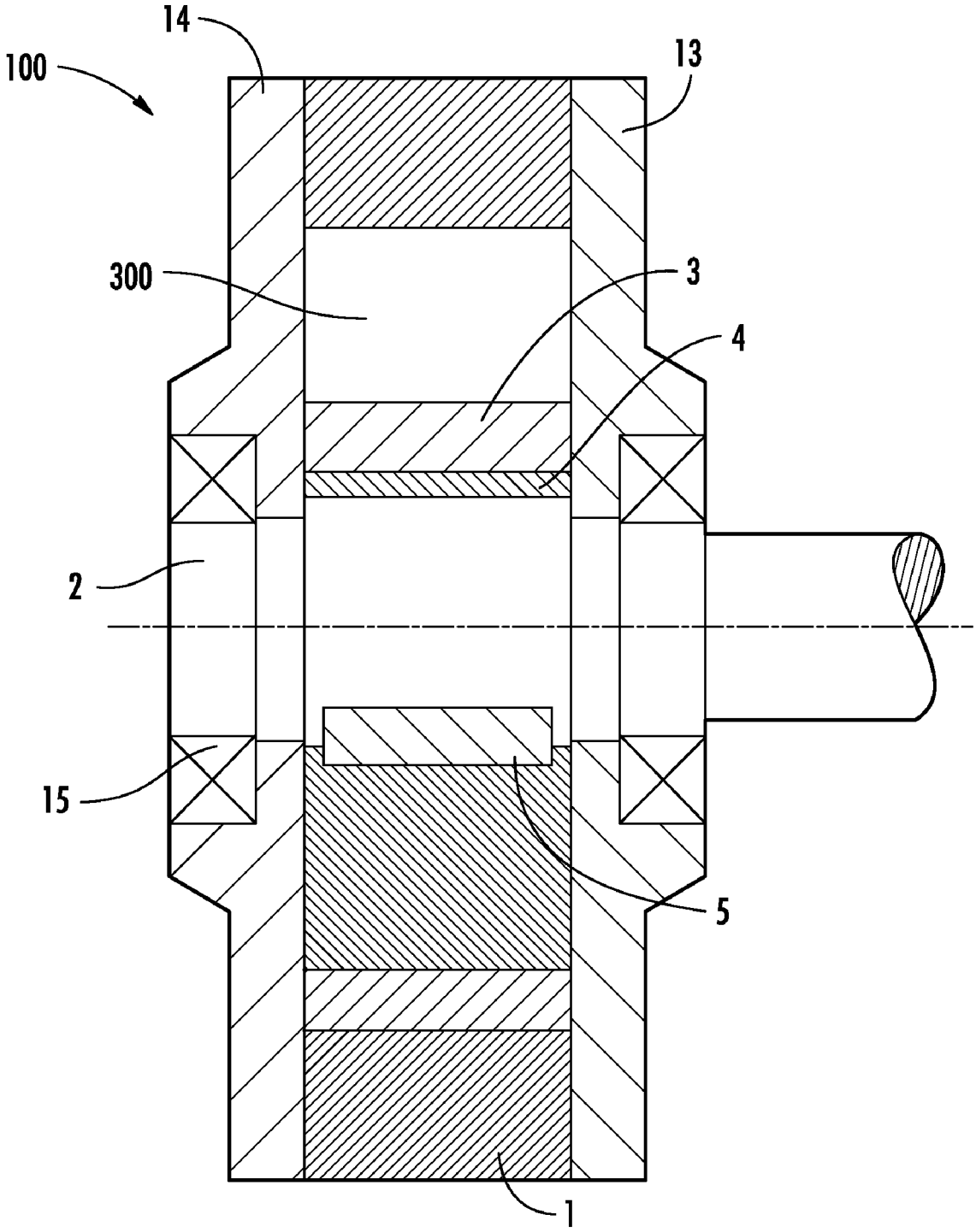
FIG. 2 is a longitudinal sectional view taken along line A-A in FIG. 1.

Reference is now made to FIGS. 1 and 2 which are respectively the cross-sectional view and the longitudinal sectional view of the rotor compressor in accordance with the first preferred embodiment of the invention.

As shown in FIGS. 1 and 2, the rotor compressor in accordance with the first preferred embodiment of the invention comprises a cylinder block 100, the cylinder block 100 is comprised of a cylindrical cylinder block body 1, a front end cover 13 and a rear end cover 14, the front end cover 13 is attached to the front end surface of the cylinder block body 1 and the rear end cover 14 is attached to the rear end surface of the cylinder block body 1. The cylinder block body 1 and the front and rear end covers 13 and 14 define an inner chamber.

In the inner chamber of the cylinder block there is disposed an eccentric rotor assembly 200, and an axially extending sealed chamber 300 is formed between the outer circumferential surface of the eccentric rotor assembly 200 and the inner wall surface of the cylinder block. The eccentric rotor assembly 200 is mounted on a shaft 2 and is circumferentially fixed by means of a key 5. The shaft 2 is supported by the bearings 15 which are respectively mounted in the front and rear end covers 13 and 14. The eccentric rotor assembly 200 has a contact portion 60 which contacts the inner wall surface of the cylinder block during the rotation of the eccentric rotor assembly 200, and an axially extending sealing region is formed at the contact portion.

A separating means 40, which separates the sealed chamber 300 into an induction chamber 70 and an exhaustion chamber 71, is provided in the cylinder block 100. On the two sides of the separating means 40, there are respectively provided an inlet 12 and an outlet 9 in the wall of the cylinder body which communicates with the induction chamber and the exhaustion chamber respectively.

As shown in FIGS. 1 and 2, the eccentric rotor assembly 200 comprises a cylindrical rotor 4 which is eccentrically mounted on the shaft 2 through a key 5, and a bush 3 is rotatably fitted over the cylindrical rotor 4. Since the bush 3 is rotatably fitted over the cylindrical rotor 4, the cylindrical rotor 4 can rotate relative to the bush 3 and drive the bush 3 when the rotor compressor operates.

The separating means 40 comprises a separator plate 8 which is pivotally mounted on the cylindrical cylinder block body 1 via a pivot shaft 11 at its one end. A contact member 7, which makes contact with the eccentric rotor assembly 200, is provided at the other end of the separator plate 8. The contact member 7 is formed with a cylindrical surface 27 extending axially; and a circular arc slot 15, which extends axially, is formed on the circumferential surface of the bush 3, and the radius of the cylindrical surface of the contact member 7 is substantially equal to or slightly smaller than the radius of the circular arc slot 15. In an assembled state, the cylindrical surface of the contact member 7 is positioned in the circular arc slot 15 formed on the circumferential surface of the bush 3, and a sealing contact is formed there between to separate the sealed chamber 300 into the induction chamber 70 and the exhaustion chamber 71.

Furthermore, a receiving recess 21 is formed in the inner wall of the cylinder block body 1, so that the separator plate 8 and the contact member 7 can be received in the receiving recess when pivoting to the uppermost position due to the rotation of the rotor assembly 200, thus improving the volume efficiency of the rotor compressor.

The pivot shaft 11 is fitted in a hole 22 which is formed in the cylinder block body 1 and extends axially, the hole 22 opens to the inner chamber of the cylinder block. The pivot shaft 11 is mounted in the hole 22 and thus is rotationally supported by the hole 22. The pivot shaft 11 is disposed between the inner end surfaces of the front and rear end covers with a necessary axial fit clearance between the shaft 11 and the inner end surfaces of the front and rear end covers, and thus the pivot shaft 11 is not associated with the end covers in any other way.

Figure 4A:
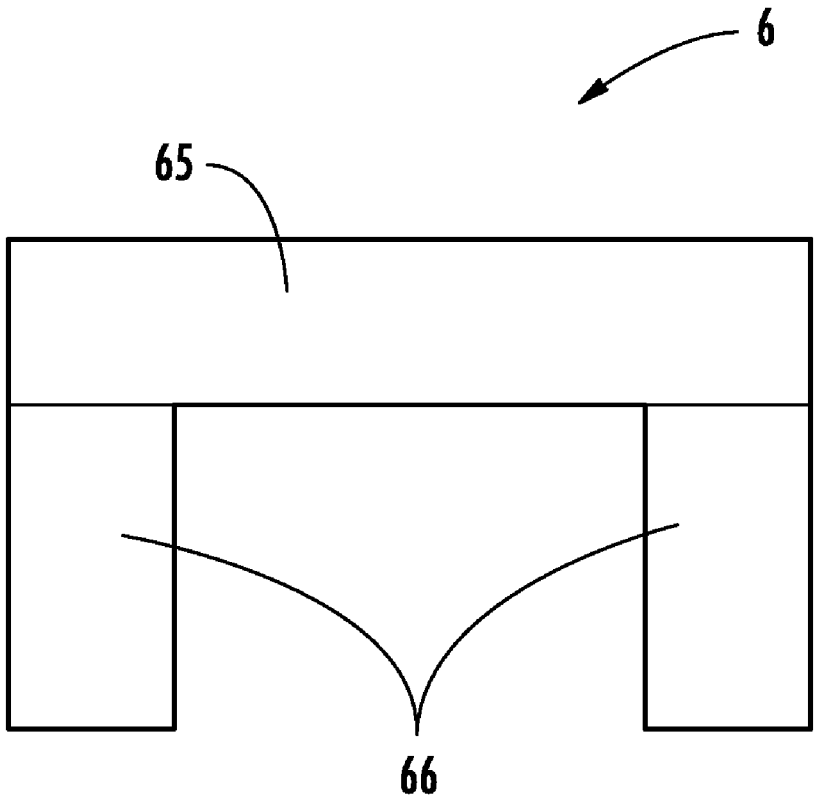
FIGS. 4A and 4B are respectively the front view and the top view of the connecting member.
Figure 4B:
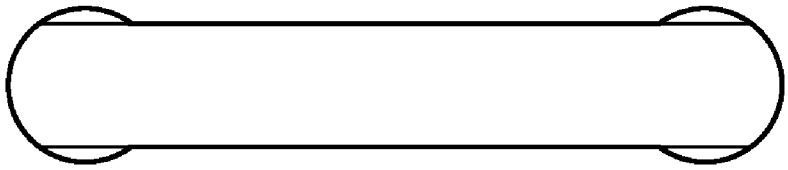

As shown in FIG. 1, a connecting member 6 is provided to connect the bush 3 of the eccentric rotor assembly 200 and the contact member 7 of the separating means 40. As shown in FIGS. 4A and 4B, the connecting member 6 takes the shape of U, and comprises two cylindrical legs 66 and a connecting part 65 which connect the two legs.

Figure 3A:
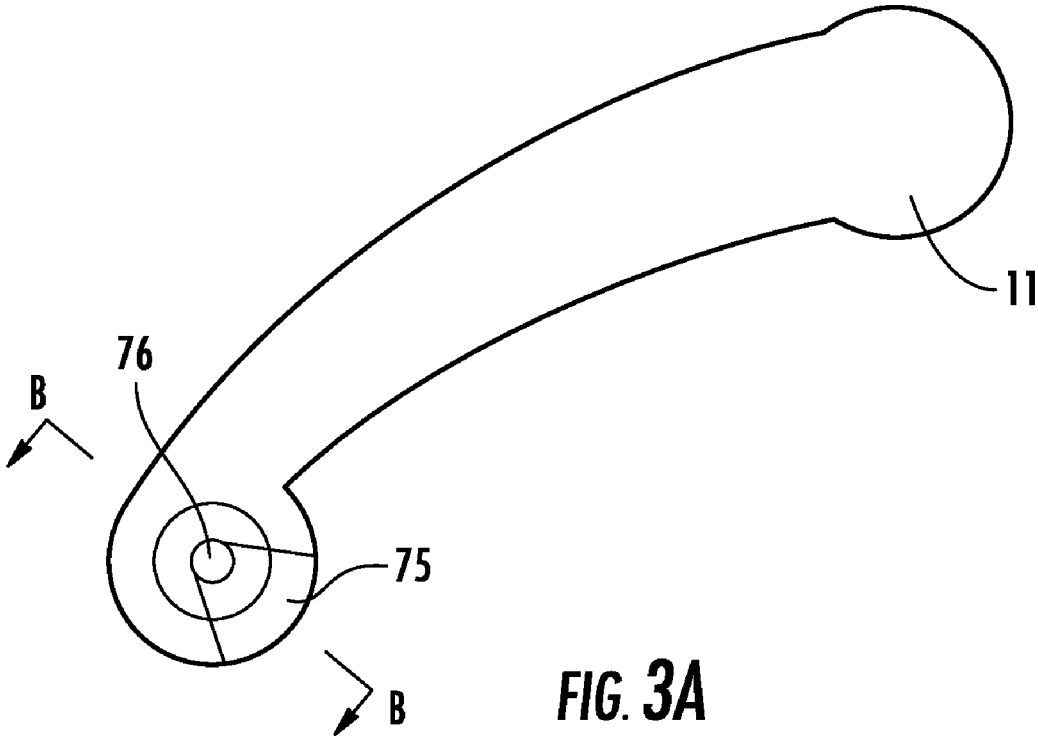
FIG. 3A is an axial end view of the separating means.
Figure 3B:
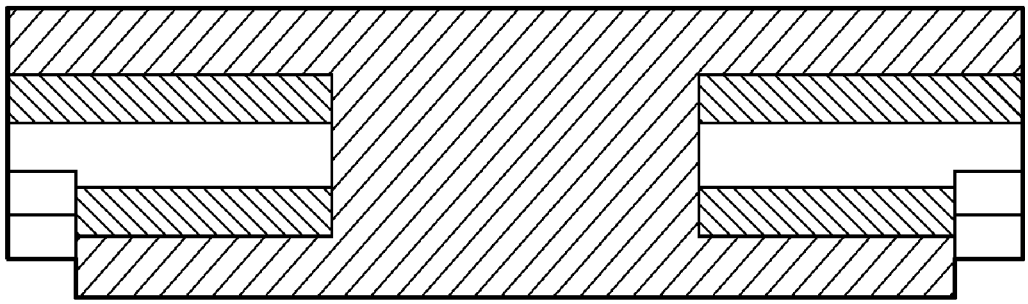
FIG. 3B is a sectional view taken along line B-B in FIG. 3A.

As shown in FIG. 3, the contact member 7 is formed with a central hole 76 at each of its two axial ends for receiving one leg 66 of the connecting member 6. Furthermore, each axial end of the contact member 7 is formed with a sectorial cutout 75 which has a center corresponding to the central hole 76. In an assembled state, the connection part 65 of the connecting member 6 is located within the sectorial cutout 75 so as not to protrude from the axial end surface of the contact member 7. The sectorial cutout 75 allows the connecting member 6 (and thus the bush 3) and the contact member 7 (and thus the separating means 40) to rotate relative to each other with the central hole 76 as the center within a range defined by the sectorial cutout 75. The circumferential size of the sectorial cutout 75 is so determined that, on one hand, it should be small enough to ensure a sealed separation between the high pressure chamber and the low pressure chamber, i.e. a situation will not occur that the two circumferential ends of the sectorial cutout communicate with the high pressure chamber and the low pressure chamber simultaneously; and on the other hand, it should be big enough to enable the connecting member 6 (and thus the bush 3) and the contact member 7 (and thus the separating means 40) to rotate relative to each other in desired range to achieve the desired operation of the rotor compressor.

Figure 5:
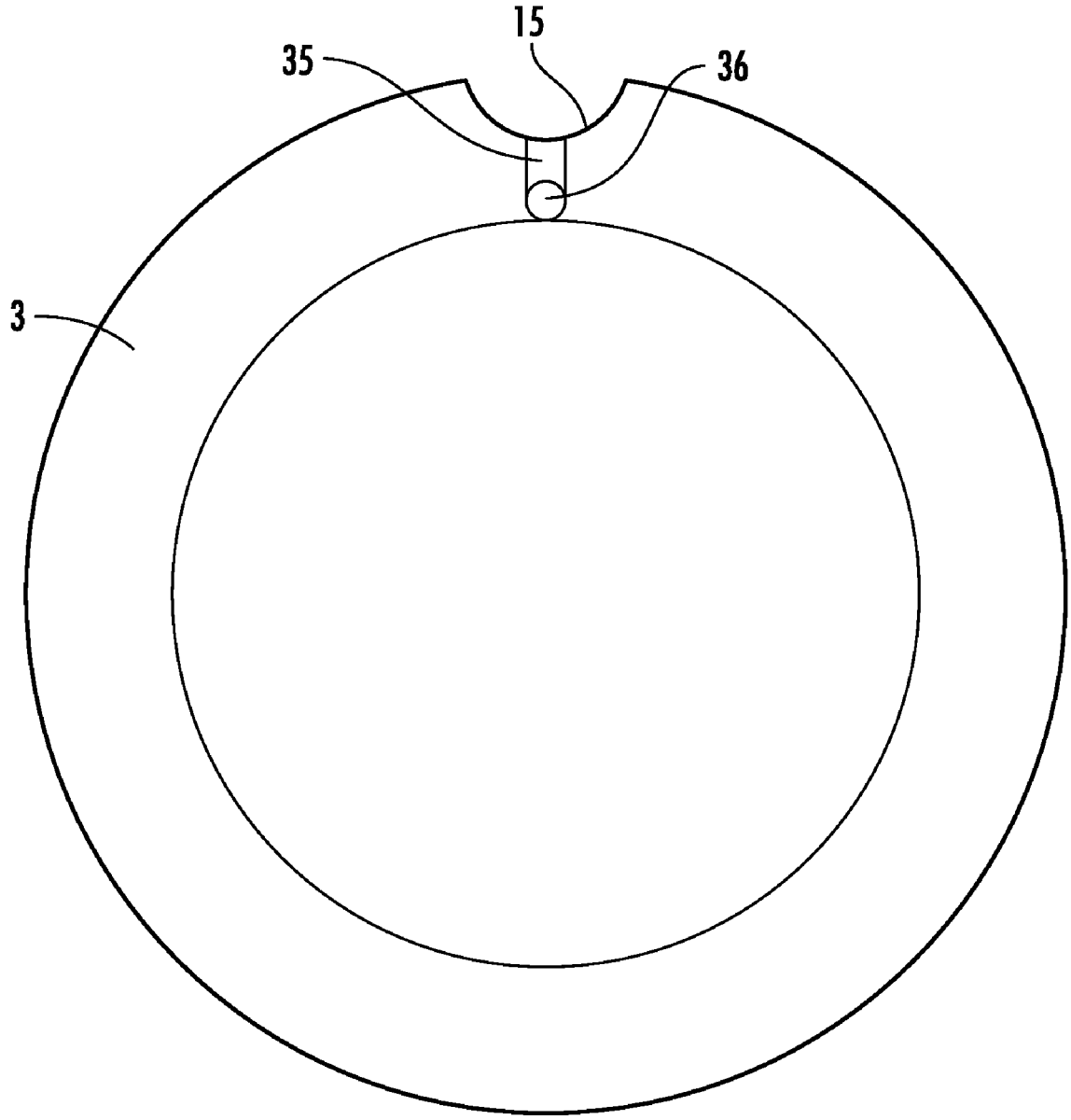
FIG. 5 is an axial end view of the bush.

As shown in FIG. 5, the bush 3 is formed with an axial hole 36 at each of its axial ends, which receives the other leg 66 of the connecting member 6. And furthermore, the bush 3 is formed with a slot 35 at each of its axial ends, which opens to the axial hole 36. In an assembled state, the connecting part 65 of the connecting member 6 is located within the slot 35 so as not to protrude from the axial end surface of the bush 3.

Figure 7A:
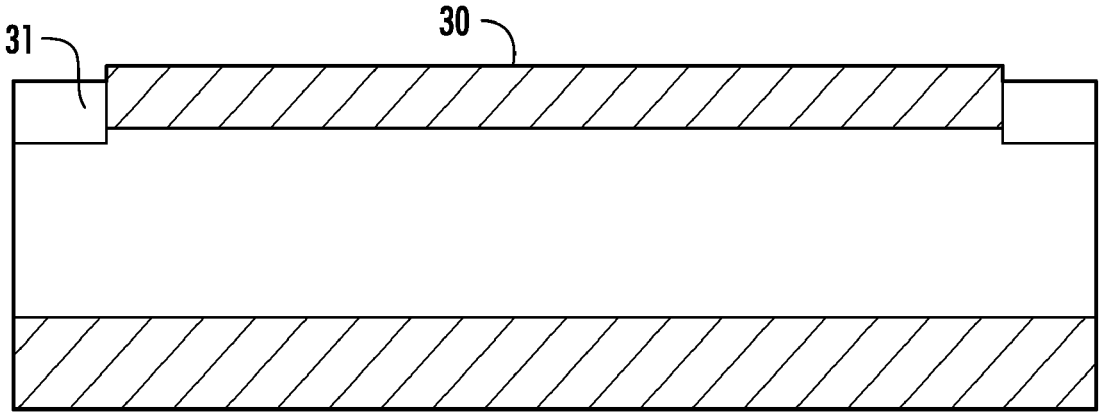
FIG. 7A is an axial sectional view of the cylindrical closing and opening member.
Figure 7B:
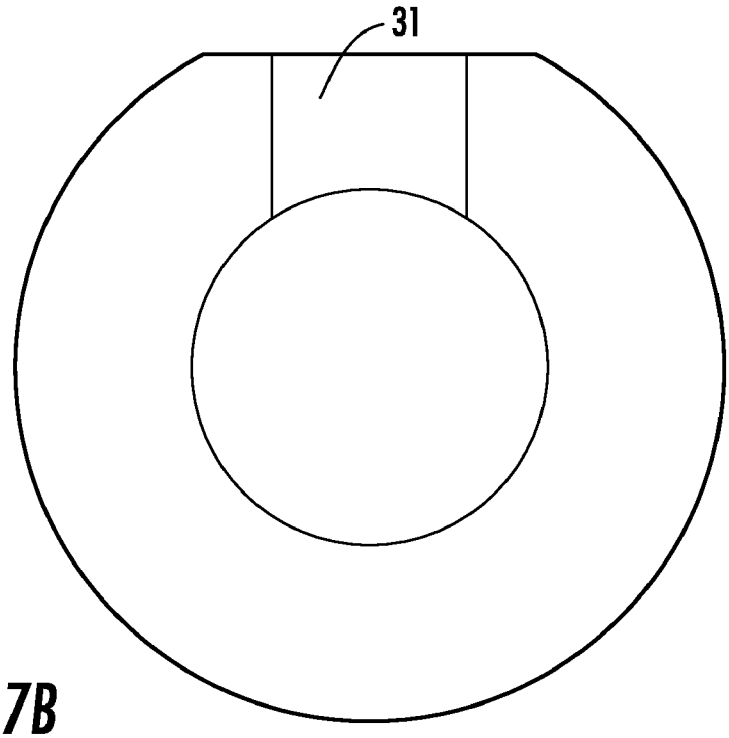
FIG. 7B is an axial end view of the cylindrical closing and opening member.

As shown in FIG. 1, the outlet 9 is provided with a check valve 10, the closing and opening member 10' is biased by a spring 10" and thus closes the outlet. Preferably, the check valve 10 is a cylindrical valve. FIG. 7 shows the structure of the cylindrical valve, in which FIG. 7A is an axial sectional view and FIG. 7B is an end view. As shown in FIGS. 7A and 7B, the closing and opening member 30 is a cylindrical member which has a radial cutout 31 formed there through at each of its two axial ends, this cutout is used to receive the guide part 33 of a guide member 32 which guides the movement of the cylindrical closing and opening member.

Figure 8A:
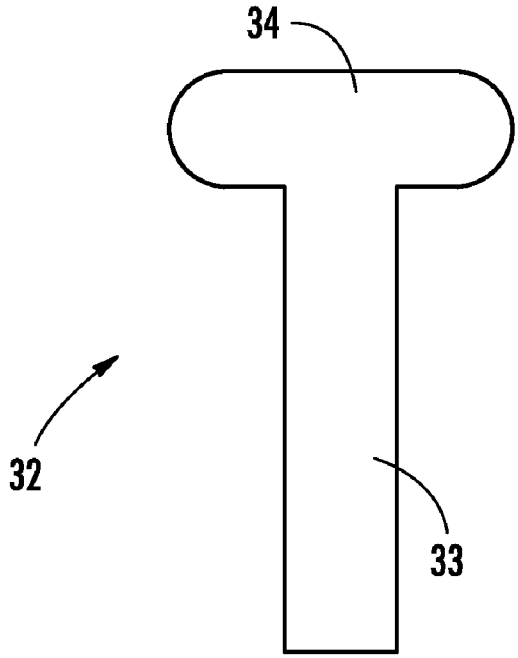
FIGS. 8A and 8B are respectively the front view and the side view of the guide member.
Figure 8B:
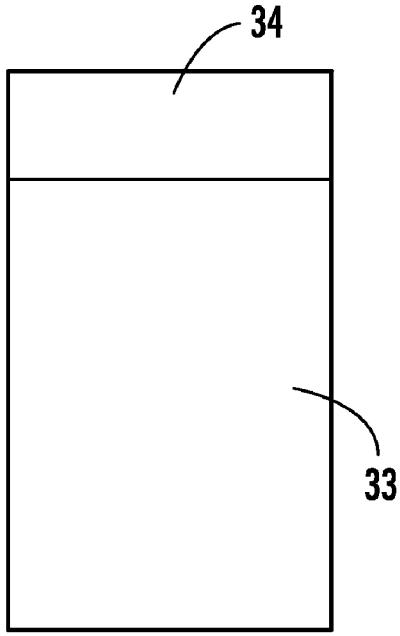

FIGS. 8A and 8B are respectively the front view and side view of the guide member 32. As shown in FIG. 8, the guide member 32 takes the shape of T, comprises a guide part 33 and a fixing part 34 connected with the guide part, and the guide part 33 is adapted to be inserted into the radial cutout 31 of the cylindrical closing and opening member 30 to guide the movement of the cylindrical closing and opening member 30.

Figure 9:
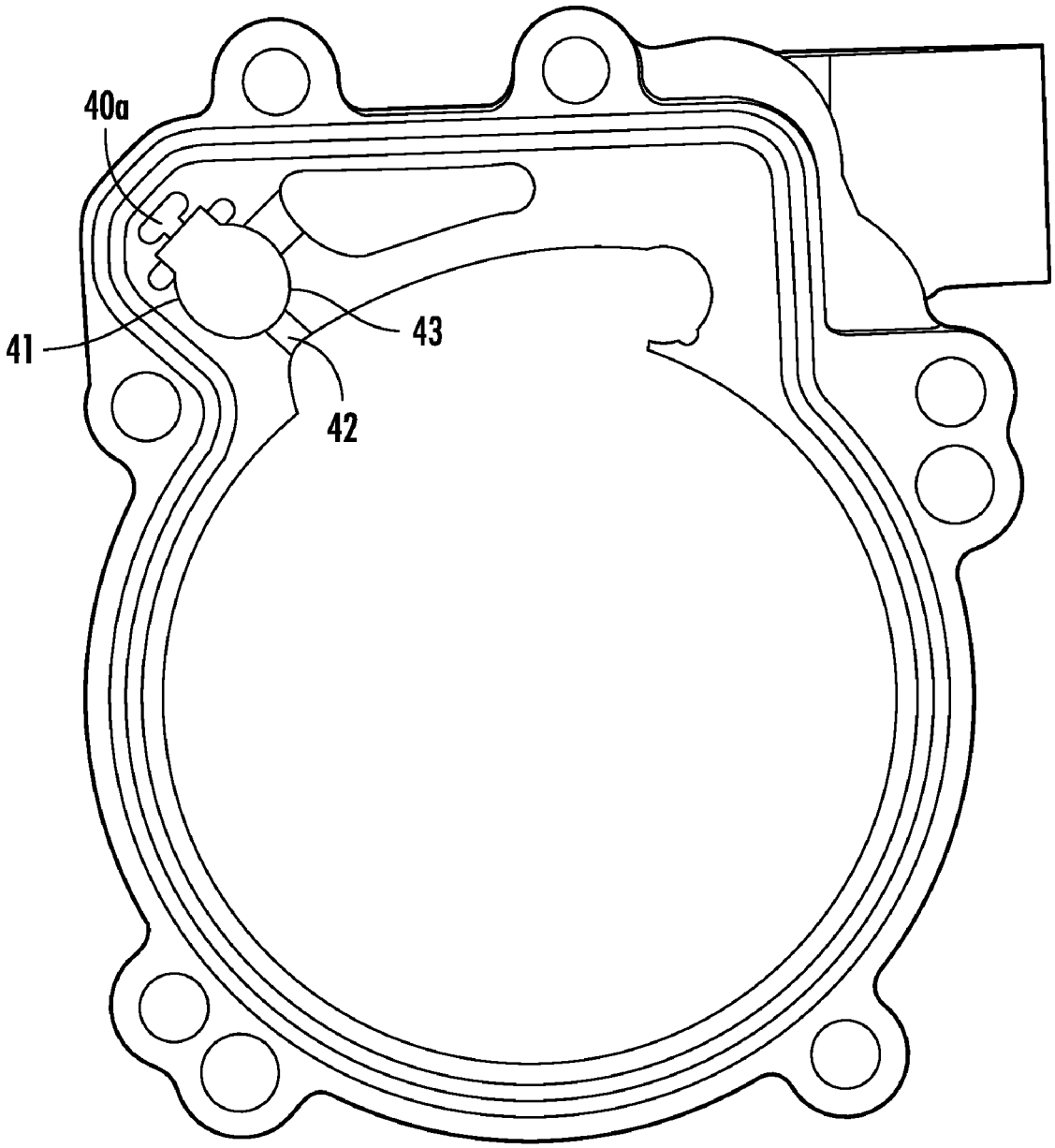
FIG. 9 is an axial end view of the cylinder block body, showing the structure formed on the cylinder block body for receiving the cylindrical valve.

As shown in FIG. 9, on the axial ends of the cylinder block body 1 there is formed with a T-shaped slot 40*a*, the radial inner end of the T-shaped slot 40*a* opens to a cavity 41 within which the cylindrical valve member 30 is accommodated, the cavity 41 communicates with the exhaustion chamber 71 via a communicating hole 42. The surface of the cavity 41 at the radial inner side is formed as a cylindrical surface 43 the radius of which is substantially the same as that of the outer circumferential surface of the cylindrical valve member 30, thus forming the mounting seat of the cylindrical valve member 30. The communicating hole 42 is formed in the cylindrical surface 43. The guide member 32 is mounted in the T-shaped slot to be fixed in place relative to the cylinder block body 1.

In an assembled state, the guide members 32 are mounted in the T-shaped slots on the axial end surfaces of the cylinder block body 1, and the cylindrical valve member 30 is mounted on the mounting seat in the form of the cylindrical surface 43, and the outer extension of the guide part 33 of the guide member 32 inserts into the radial cutout 31 of the cylindrical valve member 30; and at the same time, the cylindrical valve member 30 is biased by a spring (not shown) to close the communicating hole 42.

The cylindrical valve member 30 described above is a hollow cylindrical member. Alternatively, it can also be a solid cylindrical member.

The operation of the rotor compressor in accordance with the invention is now described in connection with the drawings.

As shown in FIG. 1, when the eccentric rotor assembly 200, which is driven by the shaft 2, rotates clockwise, the volume of the induction chamber 70 increases, and therefore a negative pressure is established in the induction chamber. As a result, gas or liquid is sucked into the cylinder via the inlet 12 which communicates with the induction chamber; at the same time, the gas or liquid in the exhaustion chamber 71 is compressed as the contact portion 60 rotates clockwise, and is discharged via the outlet 9 which communicates with the exhaustion chamber. By means of the connecting member 6 and the action of the pressure difference between the induction chamber 70 and the exhaustion chamber 71, the cylindrical surface of the contact member 7 of the separating means is kept in good contact with the circular arc slot 15 on the bush 3 all the time. Therefore, a good sealing is achieved between the induction chamber and the exhaustion chamber to allow for the above-mentioned operation. The above process is repeated continuously as the rotor assembly rotates.

The rotor compressor in accordance with the second embodiment of the invention will be described in connection with FIG. 6. The structure of the rotor compressor in accordance with the second embodiment is substantially the same as that of the rotor compressor in accordance with the first embodiment, the difference lies in the structure of the separating means 40.

Figure 6:
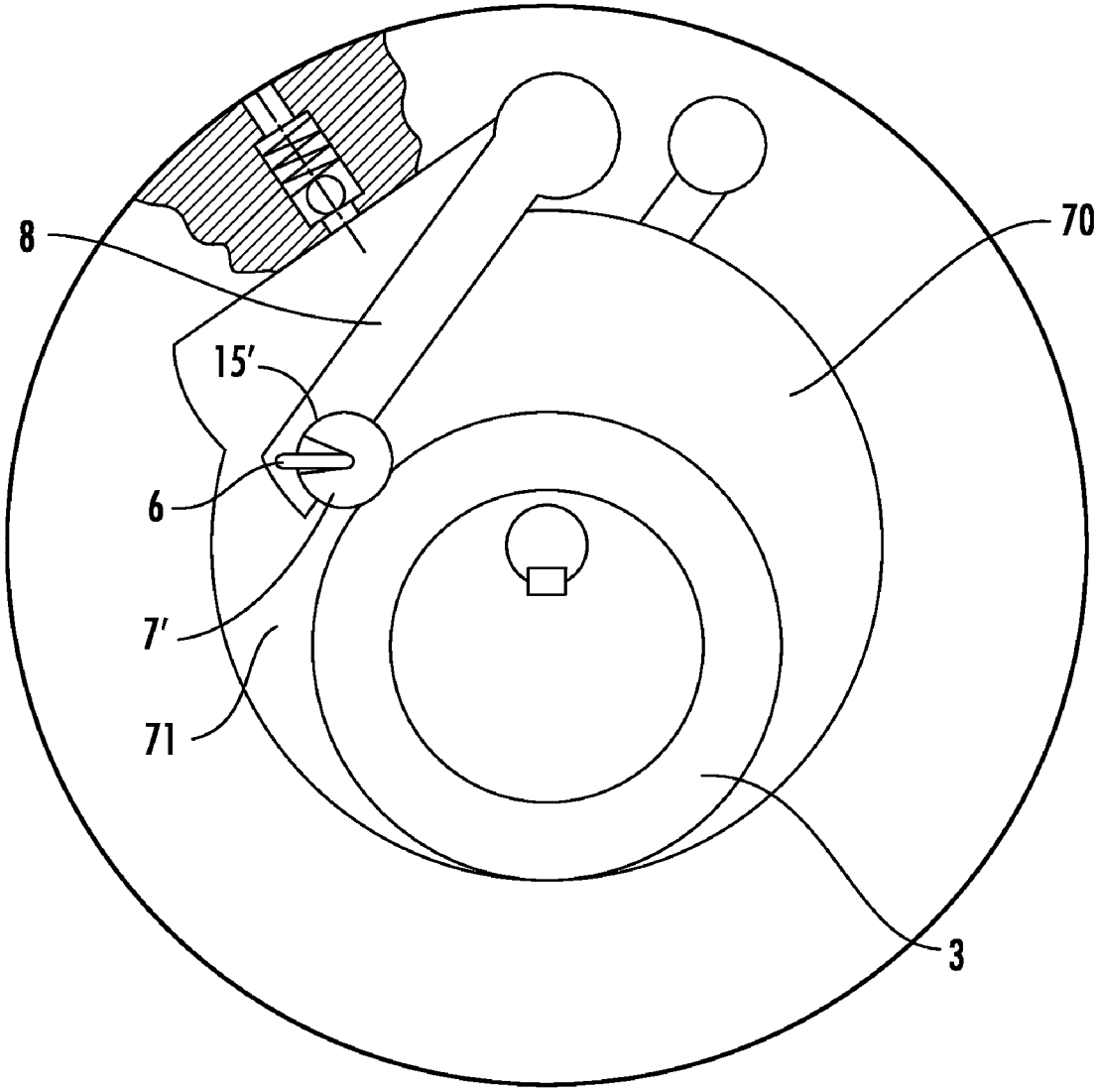
FIG. 6 is a cross-sectional view of the rotor compressor in accordance with the second embodiment of the invention.

As shown in FIG. 6, in the second embodiment of the invention, the contact member 7' with a cylindrical surface is fixedly attached to the bush 3 of the eccentric rotor assembly 200, and a side of the separator plate 8, which faces the bush 3, is formed with a circular arc slot 15' which extends axially, and the radius of the cylindrical surface of the contact member 7' is substantially equal to or slightly smaller than the radius of the circular arc slot 15'. In an assembled state, the cylindrical surface of the contact member 7' is positioned in the circular arc slot 15' formed on the separator plate 8, and a sealing contact is established therebetween to separate the sealed chamber 300 into the induction chamber 70 and the exhaustion chamber 71.

Similar to the first embodiment (refer to FIGS. 3-5), the contact member 7', which is fixedly attached to the bush 3, and the separator plate 8 are connected through the connecting member 6. The contact member 7' is formed with a central hole at each of its two axial ends for receiving one leg 66 of the connecting member 6. Furthermore, each axial end of the contact member 7' is formed with a sectorial cutout which has a center corresponding to the central hole. In an assembled state, the connecting part 65 of the connecting member 6 is located within the sectorial cutout so as not to protrude from the axial end surface of the contact member 7'. The sectorial cutout allows the connecting member 6 (and thus the separating means) and the contact member (and thus the bush) to rotate relative to each other with the central hole as the center within the range defined by the sectorial cutout. The circumferential size of the sectorial cutout is so determined that, on one hand, it should be small enough to ensure a sealed separation between the high pressure chamber and the low pressure chamber, i.e. a situation will not occur that the two circumferential ends of the sectorial cutout communicate with the high pressure chamber and the low pressure chamber simultaneously; and on the other hand, it should be big enough to enable the connecting member 6 (and thus the separating means) and the contact member (and thus the bush) to rotate relative to each other in a desired range to achieve the desired operation of the rotor compressor.

The separator plate 8 is formed with an axial hole at each of its axial ends which receives the other leg 66 of the connecting member 6. And furthermore, the separator plate 8 is formed with a slot at each of its axial ends which opens to the axial hole. In an assembled state, the connecting part 65 of the connecting member 6 is located within the slot so as not to protrude from the axial end surface of the separator plate 8.

Although the invention has been described in connection with the embodiments and the accompanying drawings, those skilled in the art will appreciate that the embodiments are only exemplary but not limitative, various modifications to the embodiments are possible without departing from the spirit and scope of the invention.

For example, in the above embodiments, the inlet 12 and the outlet 9 are respectively formed in the circumferential wall of the cylinder block body 1, however they can also be provided in the front and rear end covers.

In the above embodiments, two connecting members are used to connect the contact member 7 and the bush 3 or the contact member 7' and the separator plate 8 at the two axial ends. However, it is obvious that only one connecting member can be used to make the connection. Furthermore, the way of connecting the contact member 7 and the bush 3 or the contact member 7' and the separator plate 8 is not limited to the particular one described above, any other way, which can achieve the same function, is also possible.

In the first embodiment described above, the separator plate 8, the pivot shaft 11 and the contact member 7 are integrally formed. However, the separator plate 8, the pivot shaft 11 and the contact member 7 can also be separate members, and are fixedly attached to one another to form the separating means 40.

In the embodiments described above, the invention is described and illustrated as a rotor compressor with one cylinder. However, one skilled in the art will recognize that the invention is also applicable to a rotor compressor with more than one cylinder. Where a plurality of cylinders are applied, the cylinders may be arranged in the axial direction. The phase angle between the rotors in the cylinder blocks may be equal to 360 degrees/n, where n is the number of the cylinders.

What is claimed is:

1. A rotor compressor, comprising:

a cylinder block which comprises a cylinder block body, a front end cover and a rear end cover which are attached to a front end surface and a rear end surface of said cylinder block body respectively, said cylinder block body and said front and rear end covers defining an inner chamber;

an eccentric rotor assembly fitted in the inner chamber of the cylinder block, the eccentric rotor assembly comprising a cylindrical rotor and a bush which is rotationally fitted over the cylindrical rotor, the bush contacting an inner wall of the cylinder block so as to form an axially extending sealing region;

a shaft, said cylindrical rotor being mounted on the shaft and being rotatable there with;

separating means for separating an axially extending sealed chamber into an induction chamber and an exhaustion chamber, said axially extending sealed chamber being formed between the outer circumferential surface of the eccentric rotor assembly and the inner wall surface of the cylinder block, said induction chamber and said exhaustion chamber communicating with an inlet and an outlet respectively;

wherein said separating means comprising:

a separator plate which is provided with a pivot shaft at an end opposite to the eccentric rotor assembly, said cylinder block body being formed with an axially extending hole which opens to the inner chamber, said pivot shaft being fitted in the hole and being rotatably supported by the hole so that said separator plate rotates in a predetermined range;

one of the separator plate and the bush being provided with a contact member, the contact member comprising an axially extending cylindrical surface, and the other one of the separator plate and the bush being formed with an axially extending circular arc slot, said cylindrical surface being positioned in the circular arc slot and making a sealing contact with the circular arc slot;

said contact member being connected with said other one of the separator plate and the bush by means of a connecting member, the connection provided by the connecting member allowing the separator plate and the bush to rotate relative to each other with a central axis of the cylindrical surface as an axis.

2. The rotor compressor of claim 1, wherein said contact member is fixedly attached to said separator plate, and said axially extending circular arc slot is formed on an outer circumferential surface of said bush.

3. The rotor compressor of claim 2, wherein said contact member is formed with an axial hole at an axial end thereof and a sectorial cutout with said axial hole as a center, and a center of said axial hole coincides with a center of said cylindrical surface of said contact member;

the bush is formed with an axial hole at an axial end thereof and a slot which opens to said axial hole;

said connecting member takes the shape of U, its two legs are respectively received in said axial hole of said contact member and said axial hole of said bush, and a connecting part, which connects said two legs of said connecting member, is located within said sectorial cutout of said contact member and said slot of said bush.

4. The rotor compressor of claim 1, wherein said contact member is fixedly attached to said bush, and said axially extending circular arc slot is formed on said separator plate.

5. The rotor compressor of claim 4, wherein said contact member is formed with an axial hole at an axial end thereof and a sectorial cutout with said axial hole as a center, and a center of said axial hole coincides with a center of said cylindrical surface of said contact member;

said separator plate is formed with an axial hole at an axial end thereof and a slot which opens to said axial hole;

said connecting member takes the shape of U, its two legs are respectively received in said axial hole of said contact member and said axial hole of said separator plate, and a connecting part, which connects said two legs of said connecting member, is located within said sectorial cutout of said contact member and said slot of said separator plate.

6. The rotor compressor of claim 1, wherein said inlet and outlet are formed on the cylinder block body or the front and rear end covers.

7. The rotor compressor of claim 1, wherein a receiving recess is formed in the inner wall of the cylinder block body, so that the separator plate is received in the receiving recess when pivoting to the uppermost position due to the rotation of said rotor assembly.

8. The rotor compressor of claim 1, wherein said outlet is provided with a check valve which takes the form of a cylindrical valve, said cylindrical valve comprises a cylindrical closing and opening member for closing said outlet of said exhaustion chamber.

* * * * *

UNITED STATES PATENT AND TRADEMARK OFFICE

CERTIFICATE OF CORRECTION

PATENT NO. : 8,075,292 B2
APPLICATION NO. : 12/374479
DATED : December 13, 2011
INVENTOR(S) : Hiu Ying Wan It is certified that error appears in the above-identified patent and that said Letters Patent is hereby corrected as shown below:

Title page, item [12], line 2

Yun

Should be:

Wan

Also on title page, line 4

(76) Inventor: Xiaoying Yun, Beijing (CN)

Should be:

(76) Inventor: Hiu Ying Wan, Beijing (CN)

Signed and Sealed this
Fifteenth Day of April, 2014

Michelle K. Lee

Michelle K. Lee
*Deputy Director of the United States Patent and Trademark Office*